United States Patent [19]

Takita et al.

[11] 4,174,901

[45] Nov. 20, 1979

[54] FILM SQUEEGEE MECHANISM OF AUTOMATIC FILM DEVELOPING APPARATUS

[75] Inventors: Nobuhiro Takita; Tadashi Shintani, both of Kyoto, Japan

[73] Assignee: Dainippon Screen Seizo Kabushiki Kaisha, Japan

[21] Appl. No.: 803,219

[22] Filed: Jun. 3, 1977

[51] Int. Cl.[2] ..... G03D 3/08

[52] U.S. Cl. ..... 354/322; 226/189; 134/122 P; 15/100

[58] Field of Search ..... 354/313, 314, 316, 319, 354/320, 321, 322; 226/189; 134/64 P, 122 P; 15/100

[56] References Cited

U.S. PATENT DOCUMENTS

| | | | |
|---|---|---|---|
| 1,487,375 | 3/1924 | Fuchs | 15/100 |
| 2,913,974 | 11/1959 | Sabel et al. | 354/322 |
| 3,072,310 | 1/1963 | Kunz | 226/189 |
| 3,366,025 | 1/1968 | Layne | 226/189 |
| 3,463,073 | 8/1969 | Knibiehly | 134/122 P |
| 3,532,048 | 10/1970 | Hope et al. | 354/322 |
| 3,922,702 | 11/1975 | Gaskell | 134/122 P |
| 4,003,070 | 1/1977 | Merz et al. | 354/322 |
| 4,012,753 | 3/1977 | Schmidt | 354/316 |
| 4,034,389 | 7/1977 | Huss | 354/322 |

*Primary Examiner*—L. T. Hix
*Assistant Examiner*—Alan Mathews
*Attorney, Agent, or Firm*—Lackenbach, Lilling & Siegel

[57] ABSTRACT

A film squeegee mechanism of an automatic film developing apparatus including developing, fixing and washing means. Film squeegee means incorporated in the film transport means contacting with film to be treated with proper pressure and relative speed to film surface are provided between two liquid treating tanks of film transport means of the automatic film developing apparatus, scraping off liquid and minimizing the amount of treating liquids carried over by the film from one tank to the next.

4 Claims, 23 Drawing Figures

FILM SQUEEGEE MECHANISM OF AUTOMATIC FILM DEVELOPING APPARATUS

The present invention relates to film squeegee mechanism of automatic film developing apparatus, and more particularly to a film squeegee mechanism incorporated between several liquid treating tanks of an automatic film developing apparatus.

The automatic film developing apparatus includes a developing means, a fixing means, a washing means and a drying means. An exposed film is successively passed through the continuous treating means, whereby the film is successively developed, fixed, washed and dried, and then the finished film is discharged.

Many film processer transport means have been heretofore proposed, as shown in FIGS. 1 to 6. However, the conventional film transport means have defects such as carrying a large amount of treating liquids from one liquid treating tank to another, undesirable over development, uneven development, neighboring effect, deterioration of grain quality, and the like.

Thus, it is an object of the present invention to provide a squeegee mechanism for an automatic film developing apparatus free from the defects described above.

According to the present invention this object is accomplished by providing film squeegee means for a film transport means, contacting a film to be treated with proper pressure and relative speed to the film surface to remove the treating liquid and minimize the amount of liquid carried over by the film from one liquid tank to the next of the automatic film developing apparatus.

Objects, features and advantages of the present invention will be apparent from the following descriptions of the prior art and the present invention when taken in connection with the accompanying drawings, in which.

Figure 2:
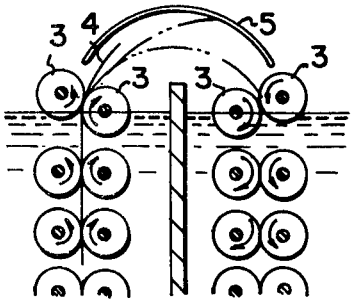
FIGS. 2 and 3 are longitudinal sectional views of conventional roller type film transport means with the use of a guide member in a transfer portion.
Figure 3:
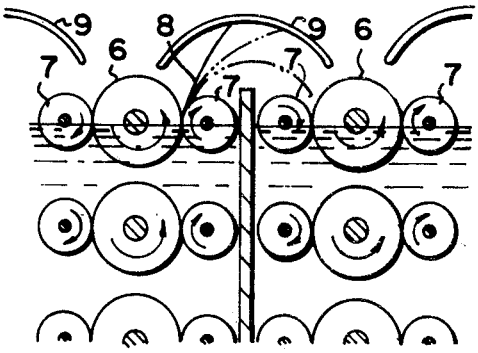
Figure 4:
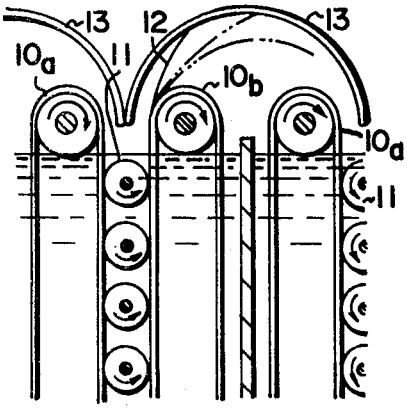
FIGS. 4 to 6 are longitudinal sectional views of conventional belt roller type film transport means with the use of a guide member in a transfer portion.
Figure 7:
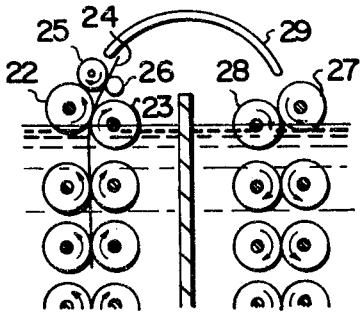
Figure 8:
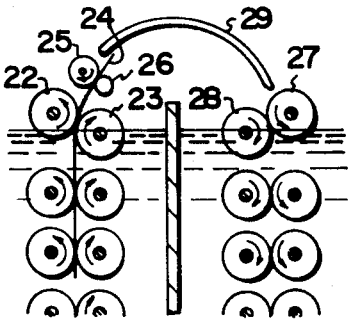
Figure 9:
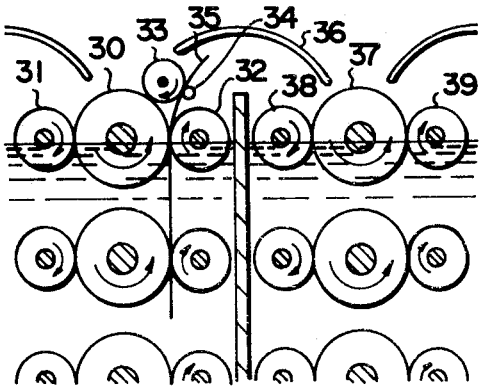
Figure 10:
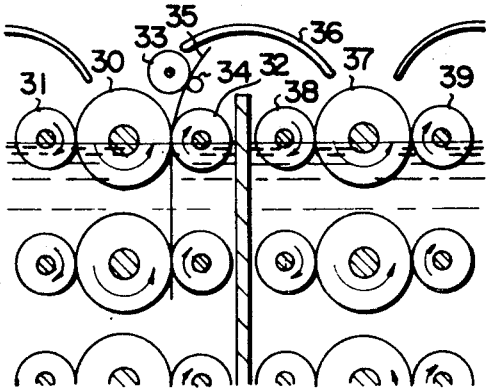
Figure 11:
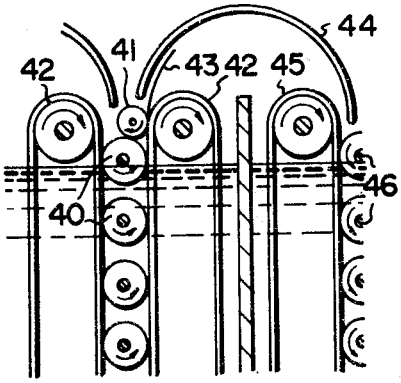
Figure 12:
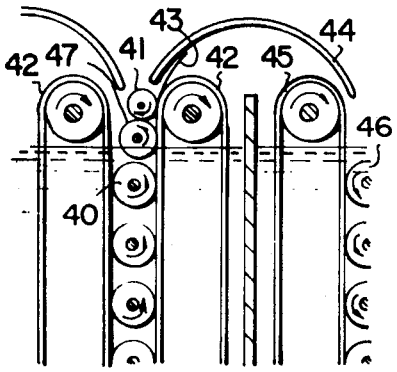
Figure 15:
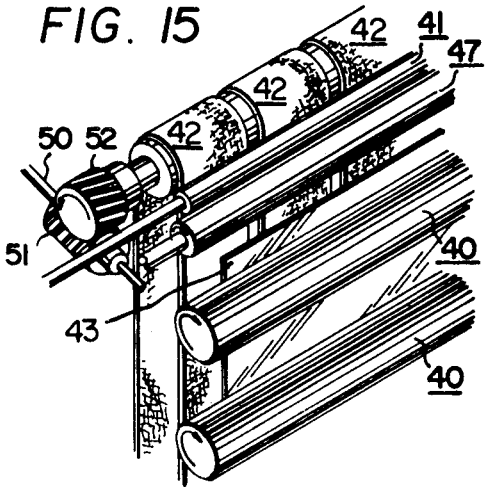

FIG. 7 is a longitudinal sectional view of roller type film transport means according to the present invention when it is applied to the system shown in FIG. 2, in which a squeegee roller is oppositely rotated in direct contact with the uppermost film transport roller, and FIG. 8 is the same as FIG. 7 except that a squeegee roller is oppositely rotated not in direct contact with the uppermost film transport roller;

FIGS. 9 and 10 are longitudinal sectional views a roller type film transport means according to the present invention when it is applied to the system shown in FIG. 3;

FIGS. 11 to 14 are longitudinal sectional views of a belt roller type film transport means according to the present invention when it is applied the system shown in FIG. 4;

FIG. 15 is a perspective view of belt roller type film transport means according as invention applied to one shown in FIG. 12.

Figure 5:
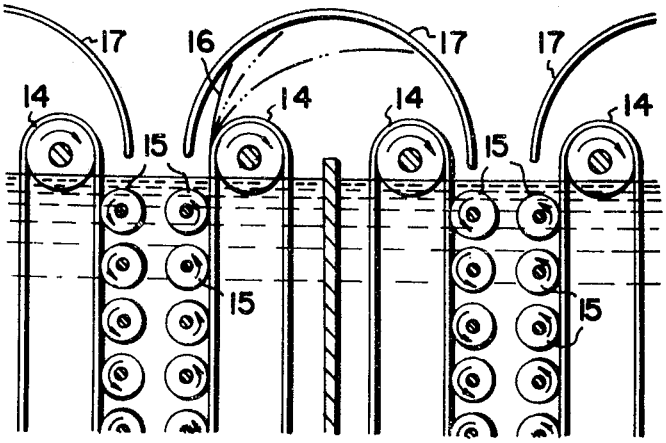
Figure 6:
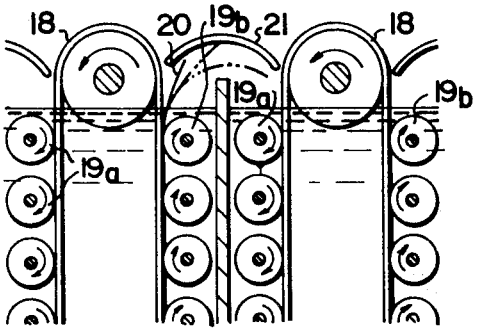
Figure 18:
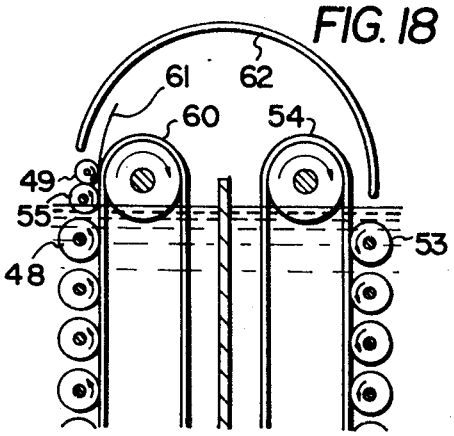
Figure 19:
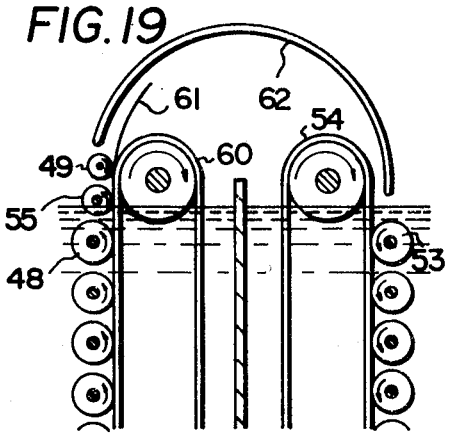
Figure 21:
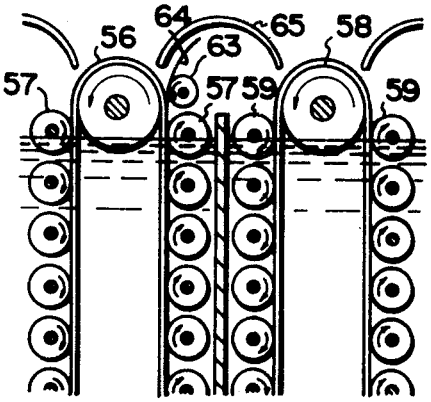
Figure 20:
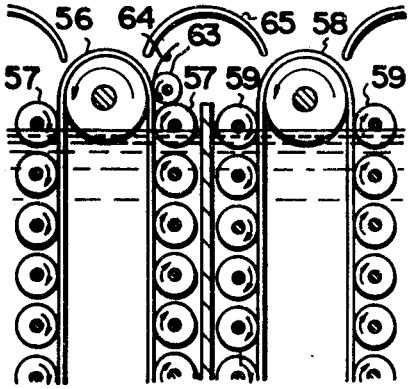
Figure 22:
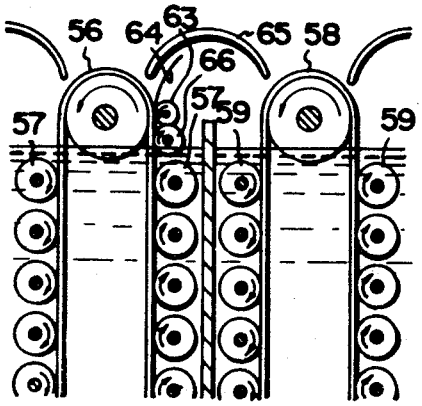
Figure 23:
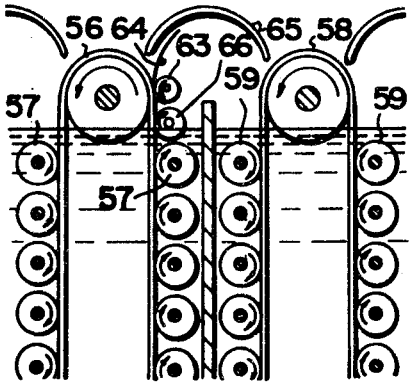

FIGS. 16 to 19 are longitudinal sectional views of a belt roller type film transport means according to the present invention when it is applied to the system shown in FIG. 5; and FIGS. 20 and 23 are longitudinal sectional views of a belt roller type film transport means according to the present invention when it is applied to the figure shown in FIG. 6.

Referring first to the conventional film transport means illustrated in FIGS. 1 to 6.

Figure 1:
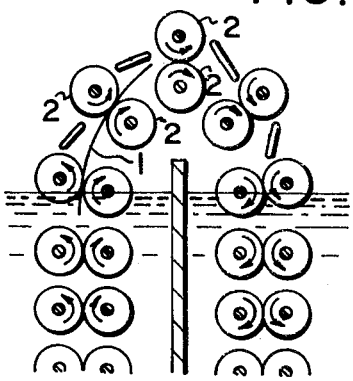
FIG. 1 is a longitudinal sectional view of a conventional roller type film transport means with the use of pairs of rollers in a transfer portion between the two tanks.

In FIG. 1, a plurality of pairs of film transport rollers 2 nip and transport a film 1 in liquid treating tanks and also in the transfer portion.

In FIG. 2, the film 4 is nipped and transported by a plurality of pairs of film transport rollers 3 in the liquid tanks and transported along a guide member 5 in the transfer portion.

In FIG. 3, one set of film transport rollers is composed of a relatively large roller 6 and two relatively small parallel rollers 7, contacting opposite ends of a diameter of sets of the large roller 6. Thus, a plurality of the large roller 6 and small rollers 7 constitute a feed in and feed out transport path. The film 8 is nipped and transported by and between the large and small rollers 6 and 7 in the liquid tanks and is fed along the guide member 9 in the transfer portion.

Alternatively, conventional belt roller type film transport means may be used. In FIG. 4, the feed-in and feed-out transport belts 10*a*, 10*b* and a plurality of a line of transport rollers 11 rotating in contact with both the belts 10*a*, and 10*b* form the transport paths, through which the film 12 travels in the liquid tanks, and the film is transported along the guide member 13 in the transfer portion.

In FIG. 5, the transport belts 14 and a plurality of rows of transport rollers 15 rotating in contact with the belts 14 constitute the feed-in and feed-out paths, through which the film 16 is transported in the liquid tanks, and the film 16 moves along the guide member 17 in the transfer portion.

In FIG. 6, the transport belts 18 and a plurality of rows of the feed-in and feed-out transport rollers 19*a*, 19*b* constitute the feed-in or feed-out paths, through which the film 20 is transported in the liquid tanks, and the film 20 travels along the guide member 21 in the transfer portion.

In the film transport means with guide members shown in FIGS. 2 to 6, the treating liquid of one tank carried by the film is mixed with the next treating liquid in the cross-over tank. For instance, the developing liquid is mixed with the fixing liquid which follows, resulting in deterioration of the fixing liquid. Accordingly, proper film treating can not be performed and large amounts of fresh treating liquids must be supplemented as required, which is an economical disadvantage.

In the transfer portion between the developing and fixing liquid tanks, the developing liquid carried by the film takes effect unnecessarily, causing deterioration of grain quality in the case of lithographic type films, and the like, and hence it is very difficult to maintain consistent developing results.

In FIG. 1, in the transfer portion of the film transport means, the film 1 is nipped and transported by the pairs of rollers 2 and the developing liquid is squeezed from the film surface by the rollers 2 rotating in the direction of the moving film. Accordingly, the amount of the developing liquid brought to the following fixing tank is less than those shown in the systems of FIGS. 2 to 6. However, since the film is squeezed by pressing the both surfaces of the film as the film moves, the developing liquid cannot be removed satisfactory from the film surfaces. In addition, because of the many contacts of the film to the rollers in the transfer portion, there will be many occurrences of uneven development of the film in proportion to the number of rollers.

Furthermore, in case of intermittent treatment of the film at certain time intervals, since no roller of the transfer portions is contact with the developing liquid, the condition of the roller surfaces changes with time, and the squeezing of the film is not uniform before the roller surfaces are moistened with the developing liquid, resulting in an increase in the occurrence of uneven development.

In the belt roller type film transport means shown in FIGS. 4 to 6, no film squeegee mechanism in the transfer portions has been hitherto propossed; only attempts to shorten the time for the film to pass through the transfer portions have been reported.

In the roller type film transport means shown in FIGS. 2 and 3, no mechanism for the exclusive purpose of squeezing the film is provided in the transfer portions, and the uppermost film transport rollers are merely used for both the transport and squeezing of the film. As a result, the defects described above such as unnecessary over-developing, occurrence of uneven development, mixing of the treating liquids and the like, have not yet been completely removed.

In FIGS. 7 to 23, examples of systems according to the present invention are shown.

In FIGS. 7 and 8, a squeegee mechanism according to the present invention is provided to the film transport means shown in FIG. 2.

In FIG. 7, the squeegee mechanism is composed of a squeegee roller 25 which rotates in a direction opposite to the moving film, an idling back-up roller 26, which rotates in the direction of the moving film.

This mechanism is located just after or above the pair of the uppermost film transport rollers 22, 23 on one side of the partition separating the developing and fixing liquid tanks. The film 24 is nipped and transported upwards by and between a row of pairs of transport rollers 22, 23, which rotate in the direction of the moving film and squeeze off a small amount of the developing liquid carried by the film surfaces and more developing liquid is removed by a squeegee roller 25 which rotates in a direction against the moving film, and in contact with the uppermost roller 22 and is backed-up through the film by the back-up roller 26. Thus, the amount of the developing liquid carried by the film surfaces is minimized.

The squeegee roller 25 reduces the developing liquid layer of the film surface to such an extent that the progress of development in the transfer portion is reduced to a minimum, that neighboring effect does not occur and grain quality and the like do not deteriorate, and that the developing liquid does not form in droplets on the film.

The dimension of the diameter of the squeegee roller 25 is in a range of $\frac{1}{4}$ to $\frac{3}{4}$ and preferably about $\frac{1}{2}$ of that of the uppermost roller 22 when the squeegee roller 25 is driven by frictional contact with the uppermost roller 22 by its own weight, but it is not restricted when the squeegee roller is driven by separate weight means.

The film 24 is transferred along the guide member 29 provide in the transfer portion and then is nipped and transported by the pairs of transport rollers 27 and 28 of the following fixing liquid tank. Since as much developing liquid is removed from the film surfaces as possible, as above-described, the film 24 is prevented from over-developing and occurrence of uneven development is minimized in the transfer portion, and the amount of the developing liquid transferred to the fixing liquid tank is also minimized.

The example according to the invention shown in FIG. 8 is the same as shown in FIG. 7 except that the squeegee roller 25 is not in contact the uppermost transport roller 22, and therefore must be independently driven, and thus the functions and effects in the case are almost the same as shown in FIG. 7.

In FIGS. 9 and 10, a squeegee mechanism according to the present invention is supplied to the film transport means shown in FIG. 3. The functions and effects are the same as shown in FIGS. 7 and 8. The film 35 is nipped and sent by and between the transport rollers 30 and 31 and 30 and 32 in the developing liquid tank and then is fed between the squeegee roller 33 and the back-up roller 34, which rotate in the directions of, and opposite to the moving film, respectively. The developing liquid is scraped off by the squeegee roller 33, and the film then travels along the guide member 36 in the transfer portion, and then is nipped and transferred by and between the transport rollers 37 and 38 and then 37 and 39 in the fixing liquid tank.

In the examples shown in FIGS. 7–10, if the contact point of the uppermost transport rollers with the film, is below the liquid level, then these rollers will not function as squeegee rollers. It would, therefore, be another possibility to install a pair of supplementary squeegee rollers prior to the squeegee rollers 25 or 33. In the case of the embodiments of FIGS. 7 and 9, they can drive the squeegee rollers 25 or 33 by frictional contact with one of the supplementary squeegee rollers instead of frictional contact with the uppermost transport roller which contacts the liquid. This will increase the squeegee effect according to the present invention.

FIGS. 11 to 23 show belt roller type film transport means equipped with a squeegee mechanism according to the present invention.

In FIGS. 11 to 14, a squeegee mechanism in accordance with the present invention is provided to the film transport means shown in FIG. 4. The film 43 is nipped and transported by and between a plurality of transport rollers 40 and transport belts 42 in the developing liquid tank, pre-squeezed by the uppermost transport roller 40 or the supplemental squeegee roller 47 rotating in the direction of the moving film, which can be provided before the squeegee roller 41 as the needs of the case demand, is squeezed by the squeegee roller 41 rotating in the direction against the moving film, transported along the carrier circular guide member 44 in the transfer portion, and is nipped and transported by and between a plurality of transport rollers 46 and transport belts 45. The squeegee roller 41 reduces the developing liquid layer of the film surfaces to such an extent that the progress of development in the transfer portion is reduced to a minimum, that neighboring effect does not occur and grain quality does not deteriorate and the developing liquid does not form droplets as above.

FIG. 15 is a perspective view of the film transport means according to the invention shown in FIG. 12. The transport endless belts 24 forming belt racks are stretched between a pair of upper and lower rollers. A worm wheel 52 secured to one end of the upper roller engages with a worm 51 on a worm shaft 50 connected to a drive means (not shown) such as an electric motor or the like and thus the belts 42 are moved by the drive means and impart motion to the developing film.

A plurality of the transport rollers 40 composing roller racks are also driven by an endless belt (not shown) extended to the worm wheel shaft. In this case, since the contact point of the uppermost transport roller 40 to the transport belt 42 is positioned under the surface of the developing liquid and thus the uppermost transport roller 40 cannot serve as a squeegee roller, the supplemental squeegee roller 47 rotating in the direction of the moving film is provided. The ends of the supplemental squeegee roller 47 are supported by the bearings of the frame (not shown) and it is contacted with the belt 42 with proper pressure, and thus it is subordinately driven by the belt 42. The squeegee roller 41 rotating in the direction against the moving film is also supported by the bearings of the frame in the same manner as the supplemental squeegee roller 47 and contacts with the supplemental squeegee roller 47 and the belt 42 by its own weight. However, the squeegee roller 41 is rotated in the direction against the moving film by the differences of the contact areas between the squeegee roller 41 and each supplemental squeegee roller 47 or transport belt 42 and the like by means of the supplemental squeegee roller 47.

Figure 13:
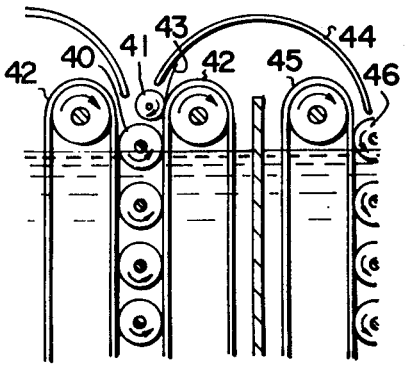
Figure 14:
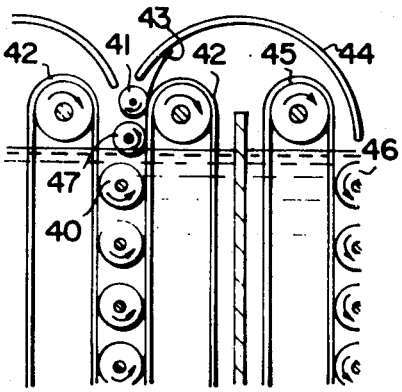

The dimension of the diameter of the squeegee roller 41 is in a range of $\frac{1}{4}$ to $\frac{3}{4}$ and preferably about $\frac{1}{2}$ of that of the supplemental squeegee roller 47 or the uppermost transport roller 40 when the squeegee roller 41 is driven by frictional contact with the supplemental squeegee roller 47 or the transport roller 40. This restriction of the dimention of the diameter of the squeegee roller 41 is determined so that the progress of the developing in the transfer portion might be kept to a minimum, so that neighboring effect does not occur and grain quality does not deteriorate so that the developing liquid layer on the film surfaces might be minimized without droplet formation, and so that the film 43 can travel without hindrance, as described above. However, the above mentioned diameter is not restricted when the squeegee roller 41 is driven by other own drive means, as shown in FIGS. 13 and 14.

In FIGS. 16 to 19, a squeegee mechanism according to the present invention is provided to the film transport means shown in FIG. 5.

The film 61 is nipped and transported by and between the transport rollers 48 and the transport belts 60 in the developing liquid, pre-squeezed by the uppermost transport roller 48 or the supplemental squeegee roller 55 rotating in the direction of the moving film, which is provided prior to the squeegee roller 49 as the needs of the case demand, is squeezed by the squeegee roller 49 rotating in the direction against the moving film in order to minimize the amount of developing liquid carried by the film surfaces, impelled along the circular guide member 62 in the transfer portion, and then nipped and transported by and between the transport rollers 53 and the transport belts 54.

Figure 16:
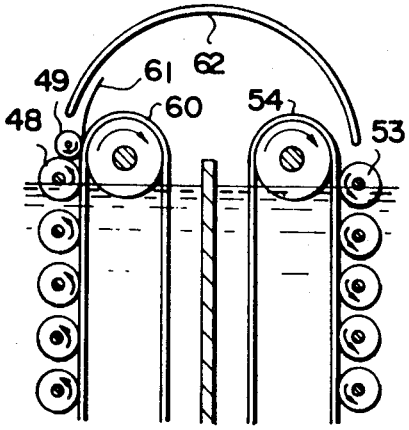
Figure 17:
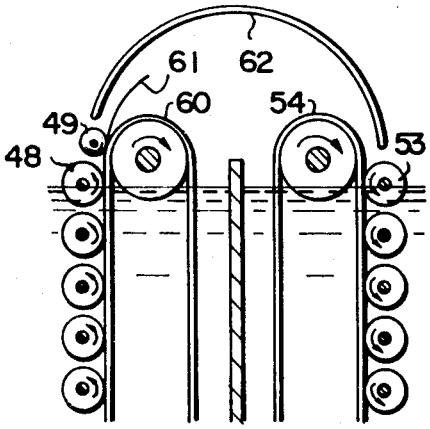

The squeegee roller 49 rotates preferably in contact with the uppermost transport roller 48 or the supplemental squeegee roller 55, as shown in FIGS. 16 and 18, but it can be provided apart from the rollers 48, 55 and independently driven, and the functions and effects are almost the same as those shown in FIGS. 17 to 19.

In FIGS. 20 to 23, a squeegee mechanism according to the present invention is supplied to the film transport means shown in FIG. 6. These cases are the same as those shown in FIGS. 11 to 14 except that the transport belts 56, 58 and the transport rollers 57, 59 are arranged in reverse positions and hence the functions and effects are the same as those shown in FIGS. 11 to 14.

According to the present invention at least one stationary roller or bar can be used instead of the squeegee roller, and the same functions and effects could be expected. In this case, however, as before, the back-up roller contacting with the stationary roller or bar rotates in the direction of the moving film.

What we claim is:

1. A film squeegee mechanism for an automatic film developing apparatus including a plurality of processing tanks and a plurality of suitably disposed transport rollers adapted to transport a film medium through each tank and between the tanks in a proper order, wherein said squeegee mechanism is disposed between two of the processing tanks and comprises a squeegee roller in contact with and rotated opposite to the direction of movement of the film medium, said squeegee mechanism being held by its own weight in frictional contact with and driven by a transport roller whose contact point with the film is located above the liquid level of the tank from which the film is being transported.

2. The film squeegee mechanism of claim 1, further comprising a backing roller disposed on the opposite side of the film medium and the squeegee roller, said backing roller in contact with the film medium and cooperating with the squeegee roller to squeegee the film medium.

3. The film squeegee mechanism of claim 1 wherein the diameter of the squeegee roller is between $\frac{1}{4}$ and $\frac{3}{4}$ of the diameter of the transport roller with which it is in contact and which drives it.

4. The film squeegee mechanism of claim 1 wherein the diameter of the squeegee roller is $\frac{1}{2}$ of the diameter of the transport roller with which it is in contact and which drives it.

* * * * *